US006536879B2

(12) United States Patent
Ito et al.

(10) Patent No.: US 6,536,879 B2
(45) Date of Patent: Mar. 25, 2003

(54) LAMINATED AND BONDED CONSTRUCTION OF THIN PLATE PARTS

(75) Inventors: Atsushi Ito, Nagoya (JP); Hitoshi Yoshida, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/956,991

(22) Filed: Sep. 21, 2001

(65) Prior Publication Data

US 2002/0036678 A1 Mar. 28, 2002

(30) Foreign Application Priority Data

Sep. 22, 2000 (JP) ..... 2000-288012
Sep. 22, 2000 (JP) ..... 2000-289328
Feb. 14, 2001 (JP) ..... 2001-037533

(51) Int. Cl.[7] ..... B41J 2/045
(52) U.S. Cl. ..... 347/71
(58) Field of Search ..... 347/68, 71, 65, 347/67

(56) References Cited

U.S. PATENT DOCUMENTS 4,680,595 A 7/1987 Cruz-Uribe et al.
5,779,837 A * 7/1998 Harvey ..... 156/153
6,361,152 B1 * 3/2002 Fujisawa ..... 347/68
6,361,155 B1 * 3/2002 Kanda et al. ..... 347/70

FOREIGN PATENT DOCUMENTS

JP 4-341853 11/1992

OTHER PUBLICATIONS

U.S. patent application Ser. No. 09/897,394, Isono et al., filed Jul. 2, 2001.
U.S. patent application Ser. No. 09/933,155, Takagi, filed Aug. 21, 2001.
U.S. patent application Ser. No. 09/933,156, Ito et al., filed Aug. 21, 2001.

* cited by examiner

*Primary Examiner*—Thinh Nguyen
(74) *Attorney, Agent, or Firm*—Oliff & Berridge, PLC

(57) ABSTRACT

A cavity plate is constructed by laminating, using an adhesive, a plurality of thin plates with ink passages, such as pressure chambers and through holes. In the periphery of the ink passages, escape grooves and holes communicating with the escape grooves are formed such that the remaining adhesive is guided into the escape grooves without entering the ink passages and that air trapped in the adhesive is discharged through the escape holes to the outside. Accordingly, a plurality of thin plates are firmly bonded to each other by a layer of adhesive, while the ink passages remain intact to allow a good flow of ink.

26 Claims, 16 Drawing Sheets

LAMINATED AND BONDED CONSTRUCTION OF THIN PLATE PARTS

BACKGROUND OF THE INVENTION

1. Field of Invention

The invention relates to laminated and bonded construction of a plurality of thin plate parts for use in an ink-jet printer head and an electrical component.

2. Description of Related Art

An on-demand type piezoelectric ink-jet printer head is disclosed in U.S. Pat. No. 4,680,595. The disclosed head includes a nozzle plate having a plurality of nozzles, a manifold plate having a manifold, and a channel plate having chambers each associated with each of the nozzles. A diaphragm plate is bonded using an adhesive to the back of the channel plate. Transducers are secured to one side of the diaphragm plate so as to be aligned with the pressure chambers.

The nozzle plate, manifold plate, and channel plate are made of a thin metal plate with a thickness of 200 $\mu$m or less.

The diaphragm plate is made of a thin metal plate with a thickness of 25 $\mu$m or less in order to efficiently transmit the deformation of the transducers.

Typically, these plates are laminated and bonded using an adhesive. Due to a pressing force applied to these plates when they are bonded, the adhesive sometimes squeezes out to the ink passages, such as the chambers, and is hardened. Consequently, ink flow may be blocked or decreased, resulting in a shortage of discharged ink.

SUMMARY OF THE INVENTION

The forgoing problem has also occurred when electrical components with small wiring patterns are assembled. Consequently, the invention addresses the forgoing problem and provides laminated and bonded construction of thin plate parts.

The invention involves electrical components made of several plates connected together using an adhesive. In one type of electrical component each of the plates includes a small wiring pattern. The pattern may be an electrical wiring pattern formed on a circuit board. Ink-jet printer heads are another type of electrical component. Each plate of an ink-jet printer head has openings which pass ink during operation. If these openings become blocked by the adhesive, the ink-jet printer head will not function properly.

Grooves are provided in each of the plates so that excessive adhesive fills the grooves and not the openings designed to pass ink. Additionally, each plate has an escape hole connected with the grooves so that excessive adhesive flows through the grooves and accumulates in the escape holes. Because the plates are stacked vertically the escape holes are aligned vertically and form a cavity for collecting adhesive.

It is an object of the invention to improve the manufacturing yield of electrical components comprised of a plurality of laminated plates and to provide higher quality electrical components.

BRIEF DESCRIPTION OF THE DRAWINGS

A preferred embodiment of the invention will be described with reference to the following figures wherein.

DETAILED DESCRIPTION OF PREFERRED EMBODIMENTS

U.S. patent application Ser. No. 09/897,394 is incorporated herein by reference in its entirety. Additionally, U.S. application Ser. No. 09/933,155 titled PIEZOELECTRIC INK-JET PRINTER HEAD AND METHOD OF FABRICATING SAME and U.S. application Ser. No. 09/933,156 titled INK-JET HEAD AND METHOD OF FABRICATING SAME are incorporated by reference in their entirety.

A piezoelectric ink-jet printer head embodying the invention will be described in conjunction with the attached drawings.

Figure 1:
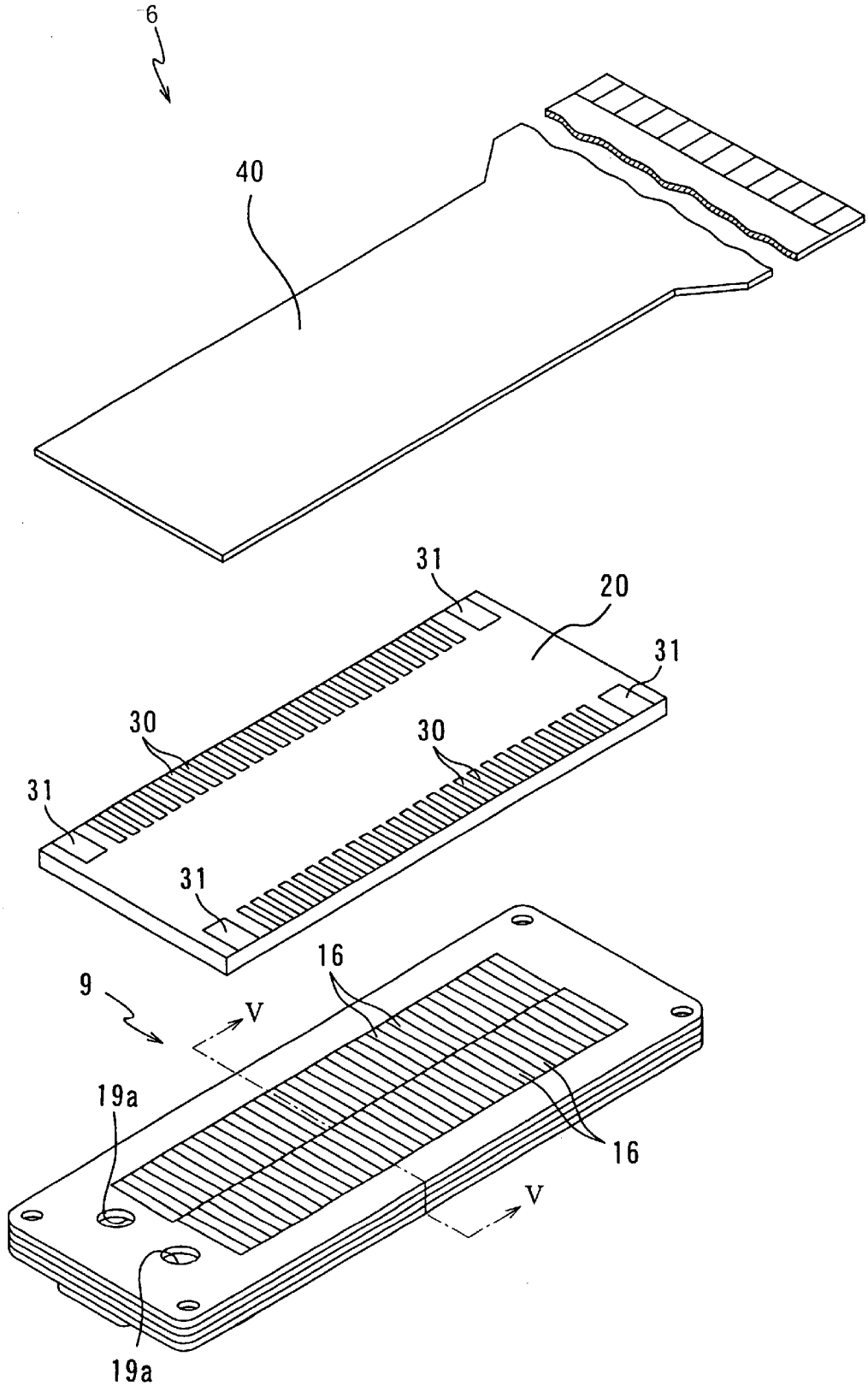
FIG. 1 is an exploded perspective view of a piezoelectric ink-jet printer head according to an embodiment of the invention.
Figure 5:
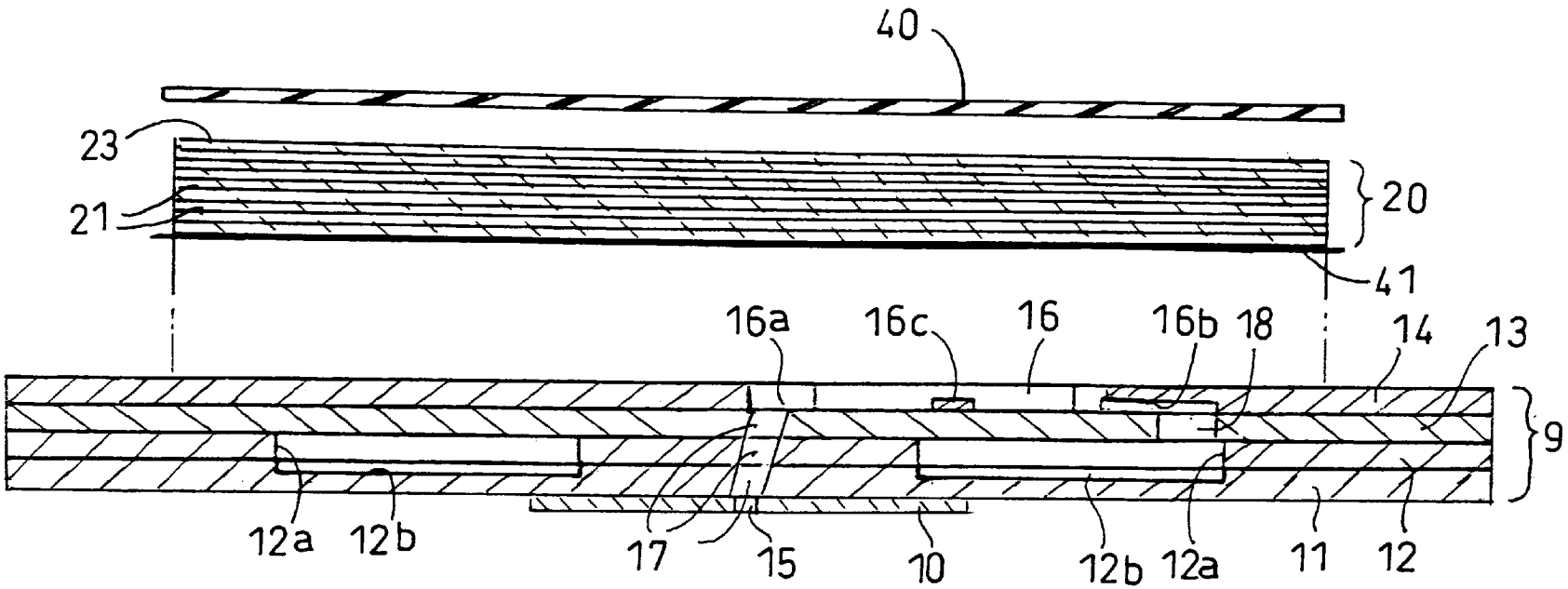
FIG. 5 is an enlarged cross-sectional view taken along line V—V of FIG. 1.

In FIG. 1, a flexible flat cable 40 is bonded, using an adhesive, to the upper surface of a plate type piezoelectric actuator 20 so as to establish an electrical connection with an external device. The piezoelectric actuator 20 is bonded to a metal cavity plate 9. Ink is ejected downward from nozzles 15, as shown in FIG. 5, which open toward the underside of the cavity plate 9 at the bottom.

As shown in FIGS. 2 through 6, the cavity plate 9 is constructed by laminating, using an adhesive, five thin metal plates, namely, a nozzle plate 10, two manifold plates 11, 12, a spacer plate 13, and a base plate 14.

Figure 3:
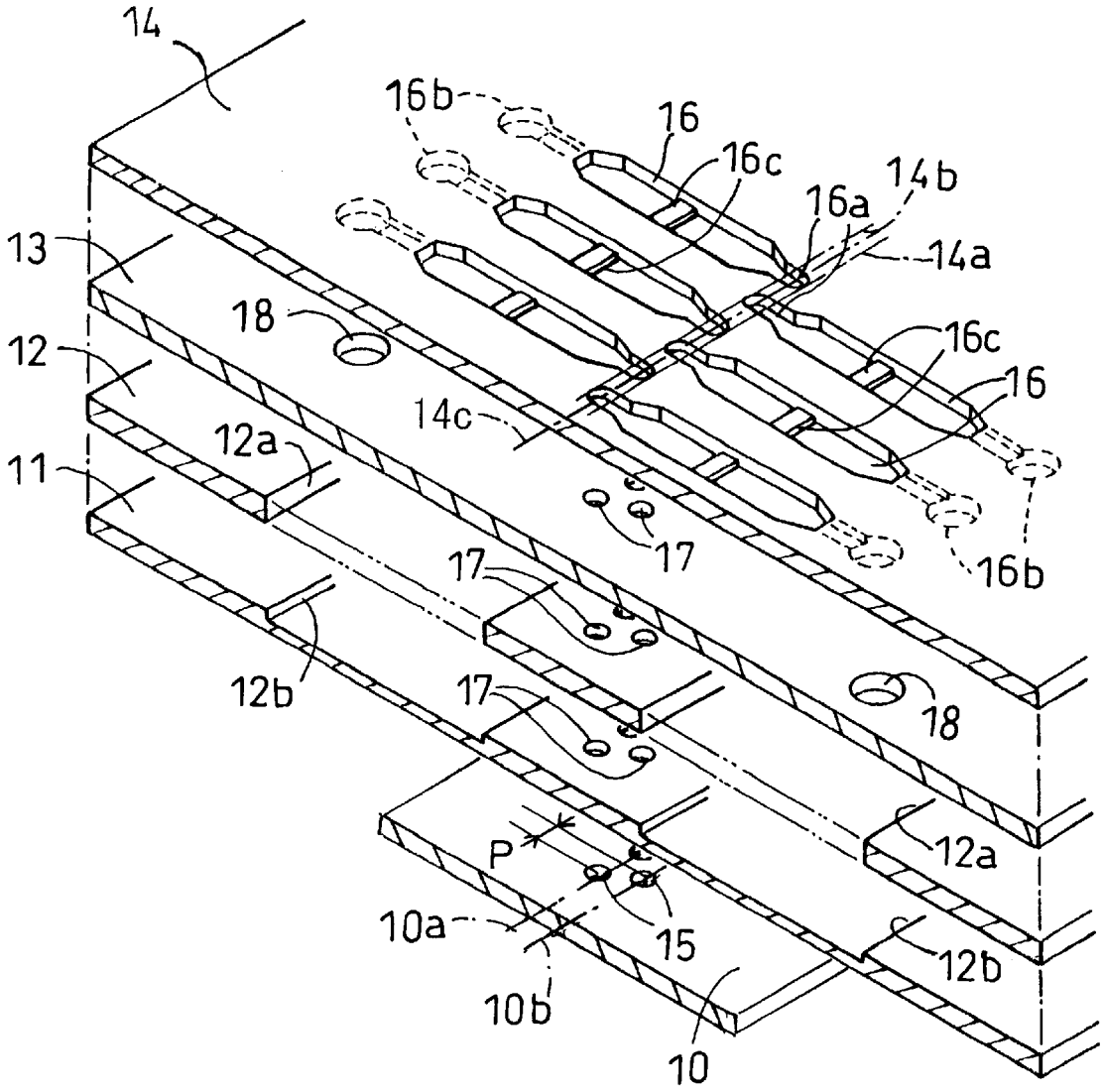
FIG. 3 is a partially exploded and enlarged perspective view of the cavity plate.

The nozzle plate 10 is made of a synthetic resin and is provided with the nozzles 15, which are as small as about 25

μm in diameter and arranged in two rows in a staggered configuration, along a longer side direction of the nozzle plate 10. Specifically, as shown in FIG. 3, a number of nozzles 15 with a small pitch of P are provided in a staggered configuration, along two reference lines 10*a,* 10*b* extending parallel to the longer side direction of the nozzle plate 10.

Each of the plates 11, 12, 13, 14 is a steel plate about 50–150 μm thick alloyed with 42% nickel. Alternatively, these plates may be resin plates.

In the manifold plates 11, 12, ink passages 12*b,* 12*a* are provided, respectively, so as to extend along both sides of the rows of nozzles 15. The ink passages 12*b* are recessed in the lower manifold plate 11, which is contiguous to the nozzle plate 10, so as to be open only toward the upper side of the lower manifold plate 11. The ink passages 12*a* in the upper manifold plate 12, which overlies the lower manifold plate 11, are formed through the manifold plate 12 into the same shape as the ink passages 12*b*.

In the manifold plates 11, 12, through holes 17 are formed at positions to be aligned with the nozzles 15 when the manifold plates 11, 12 are laminated to the nozzle plate 10.

The ink passages 12*a,* 12*b* are closed by the spacer plate 13 contiguous to the upper manifold plate 12. Likewise, through holes 17 are formed in the spacer plate 13.

In the base plate 14, a number of narrow pressure chambers 16 are provided so as to extend in the shorter side direction perpendicular to the central axis 14*c* extending along the longer side direction. When longitudinal parallel reference lines 14*a,* 14*b* are drawn on the right and left sides of the central axis 14*c,* the ends of end passages 16*a* of the pressure chambers 16 on the left side of the central axis 14*c* are aligned with the right longitudinal reference line 14*a,* while the ends of end passages 16*a* of the pressure chambers 16 on the right side of the central axis 14*c* are aligned with the left longitudinal reference line 14*b*. The opposed end passages 16*a* of the right and left pressure chambers 16 are arranged in an interlaced relationship. Thus, the right and left pressure chambers 16 extend alternately beyond the central axis 14*c*.

The end passage 16*a* of each of the pressure chambers 16 is positioned so as to be aligned with an associated one of the nozzles 15. The end passages 16*a* communicate with the spacer plate 13 and the manifold plates 11, 12, via the through holes 17, which are arranged in a staggered configuration similar to the nozzles 15.

Figure 7:
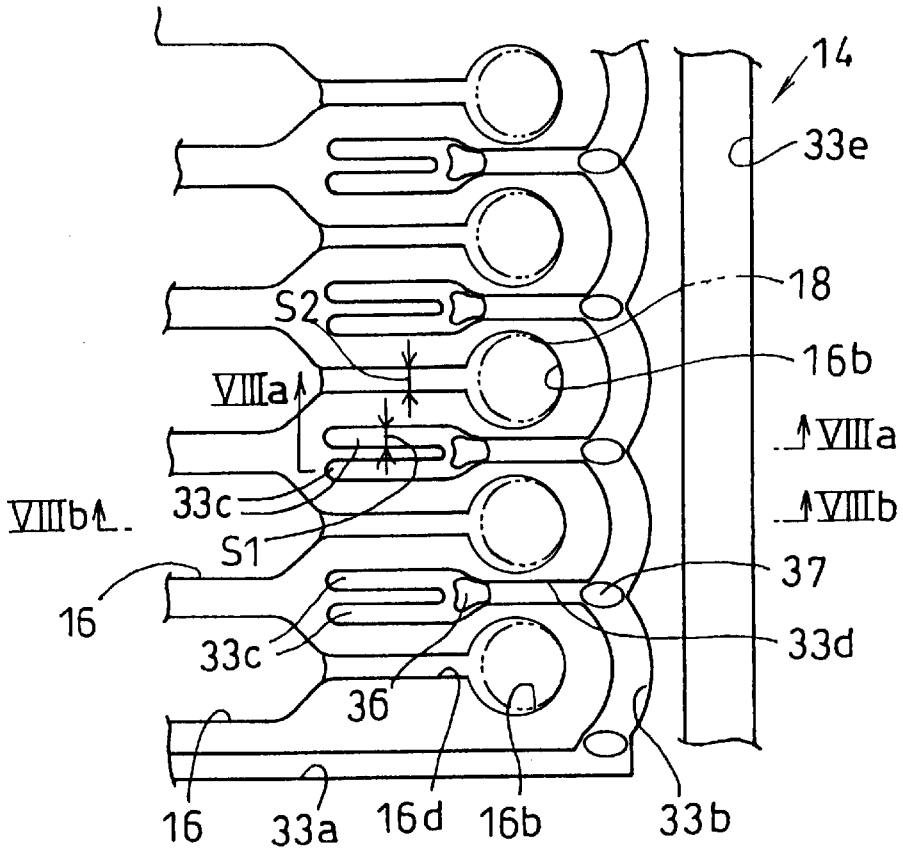
FIG. 7 is an enlarged plan view of essential portions, such as narrow grooves and escape grooves in a base plate.

At the other end of each narrow pressure chamber 16, the pressure chambers 16 are connected to large diameter hole end passages 16*b,* via elongated narrow grooves 16*d* having a small cross-sectional area. The other end passages 16*b* communicate with the ink passages 12*b,* 12*a* in the manifold plates 11, 12, via through holes 18 formed on right and left sides of the spacer plate 13. As shown in FIGS. 3 and 7, the other end passages 16*b* and the narrow grooves 16*d* are recessed so as to be open only toward the underside of the base plate 14. The other end passages 16*b* are substantially equal, in diameter, to the through holes 18.

In order to prevent ink from being excessively supplied to the pressure chambers 16, the cross-sectional area of the narrow grooves 16*d* is adapted to be smaller than that of the pressure chambers 16.

A connecting member 16*c* about half the thickness of the base plate 14 is provided for each of the pressure chambers 16 at its longitudinally intermediate position so as to enhance the rigidity of sidewalls of a number of pressure chambers 16 arranged in rows.

At one end of the base plate 14, supply holes 19*a* are formed therethrough so as to supply ink from an ink tank disposed above the base plate 14. A filter 29 is provided over the supply holes 19*a* so as to remove foreign matter from the ink.

Figure 2:
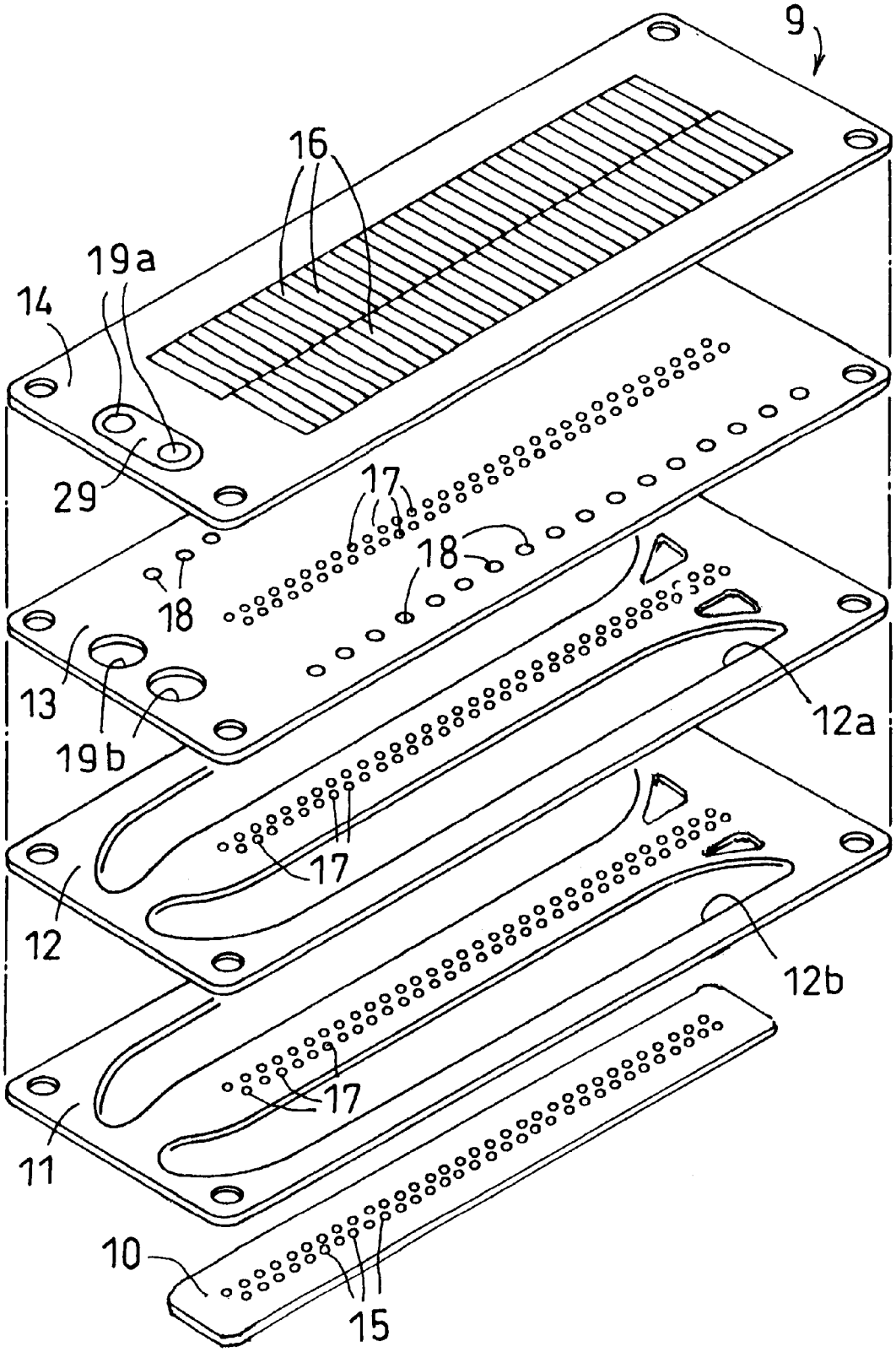
FIG. 2 is an exploded perspective view of a cavity plate.

As shown in FIG. 2, at one end of the spacer plate 13, supply holes 19*b* are formed therethrough so as to communicate with the supply holes 19*a*. The supply holes 19*b* are positioned so as to be aligned with and communicate with end portions of the ink passages 12*a,* 12*b*.

Accordingly, ink fed from the supply holes 19*a,* 19*b* flows to the ink passages 12*a,* 12*b* and passes through each of the through holes 18, thereby to be directed to each of the pressure chambers 16. After that, the ink passes through each of the through holes 17 aligned with each of the end passages 16*a* of the pressure chambers 16 and reaches an associated one of the nozzles 15.

Assembly of the cavity plate 9 will now be described.

Figure 9:
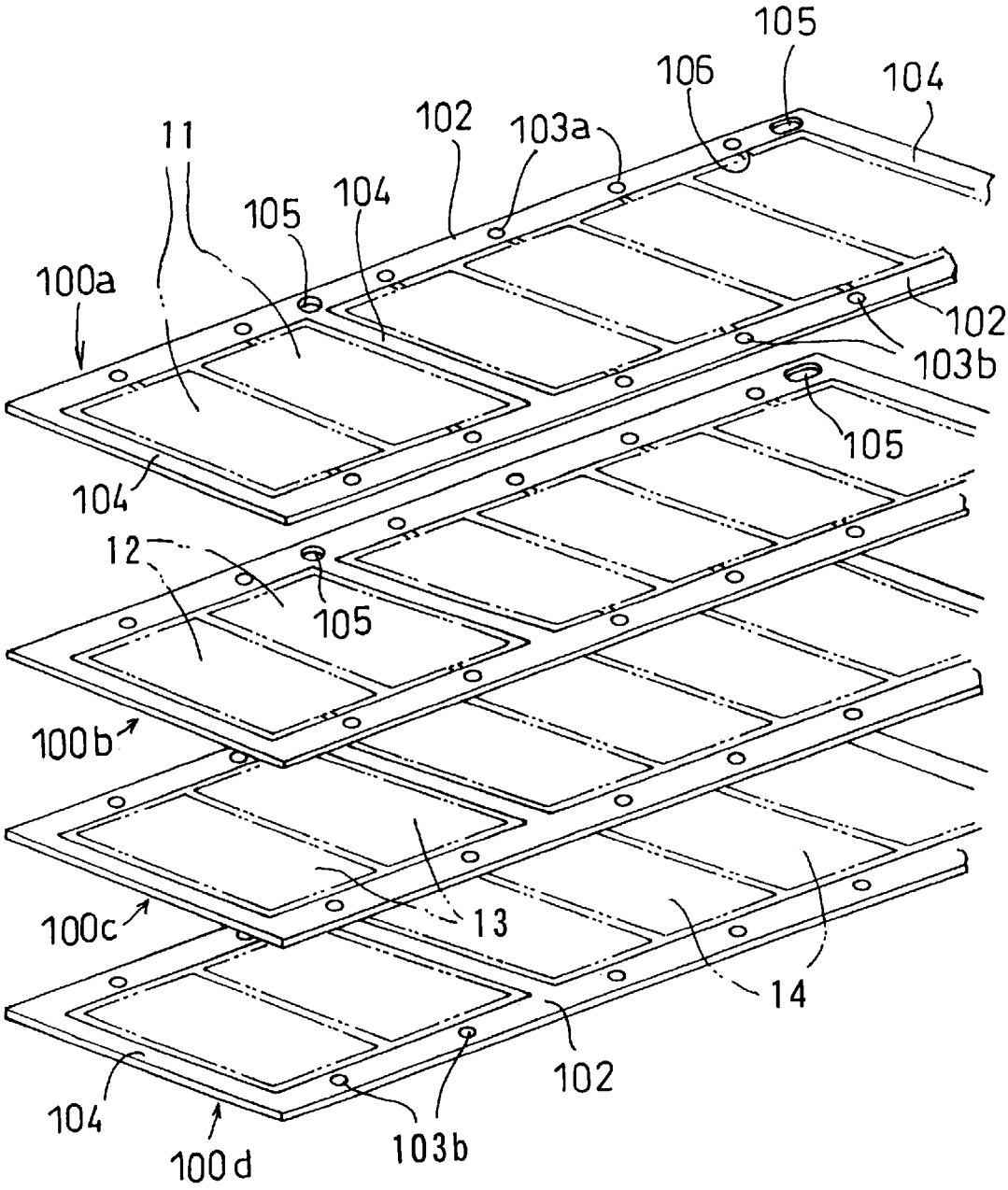
FIG. 9 is a perspective view showing laminated lead frames according to the invention and the prior art.

As shown in FIG. 9, manifold plates 11 and 12, spacer plates 13, and base plates 14, each of which is formed with a predetermined cavity pattern, are arranged at certain intervals in lead frames 100*a,* 100*b,* 100*c,* 100*d,* respectively. In the lead frame 100*d* as the bottom layer, base plates 14 are formed at certain intervals. The base plates 14 and side frames 102, 102 are linked by tie bars 104 provided at appropriate intervals. Likewise, in the lead frame 100*c* as the second layer from the bottom, spacer plates 13 are formed at the same intervals as the base plates 14. In the lead frame 100*b* as the third layer from the bottom, manifold plates 12 are formed at the same intervals. In the lead frame 100*a* as the top layer, manifold plates 11 are formed at the same intervals.

In the side frames 102 of each of the lead frames 100*a*–100*d,* positioning holes 105 are formed at appropriate intervals.

The nozzles 15, ink channels 12*a,* 12*b,* through holes 17, 18, supply holes 19*a,* 19*b* and pressure chambers 16 are formed, as described above, in the nozzle plate 10, manifold plates 11, 12, spacer plate 13, and base plate 14.

Figure 4:
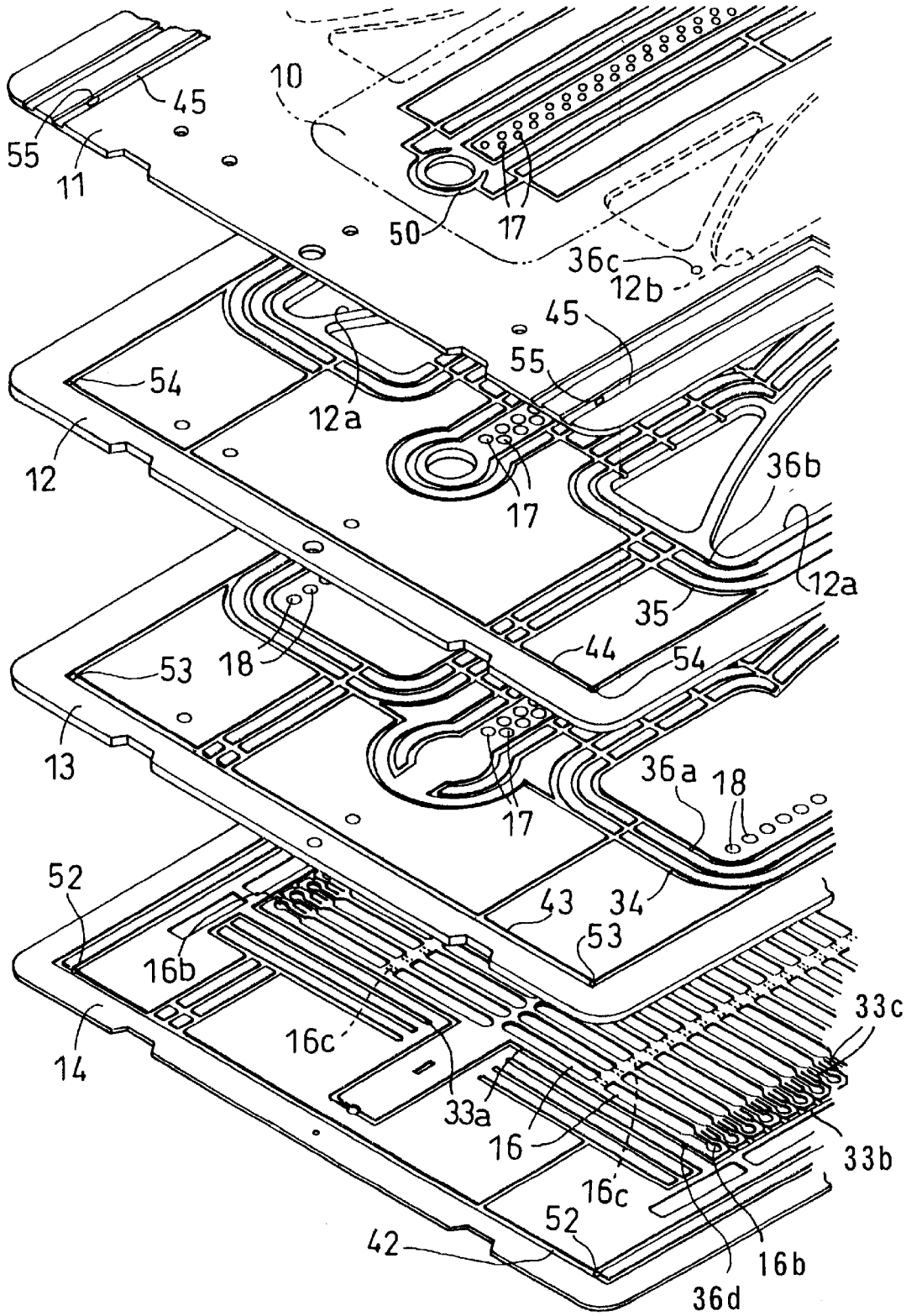
FIG. 4 is an exploded perspective view of the cavity plate with its nozzles facing upward.

On the lower surface of the manifold plate 11, that is, on the surface of the manifold plate 11 that comes into contact with the nozzle plate 10, grooves 50 are formed as shown in FIG. 4. Particularly, the grooves 50 are concentrated in the vicinity of the through holes 17. The cross-sectional area of each groove 50 in its depth direction is adapted to be smaller than that of each through hole 17.

On the lower surface of the manifold plate 12, that is, on the surface of the manifold plate 12 that comes into contact with the manifold plate 11, grooves 35 are formed lengthwise and crosswise as shown in FIG. 4. Particularly, the grooves 35 are concentrated in the vicinity of the ink passages 12*a* and the through holes 17. The vertical cross-sectional area of each groove 35 is adapted to be smaller than that of each through hole 17. Hereinafter, it is to be understood that when the term "vertical cross-sectional area" is used, it refers to the cross-sectional area of a groove or a hole in its depth direction.

On the lower surface of the spacer plate 13, that is, on the surface of the spacer plate 13 that comes into contact with the manifold plate 12, grooves 34 are formed lengthwise and crosswise as shown in FIG. 4. Particularly, the grooves 34 are concentrated in the vicinity of the through holes 17, 18. The vertical cross-sectional area of each groove 34 is adapted to be smaller than that of each hole 17, 18.

On the lower surface of the base plate 14, that is, on the surface of the base plate 14 that comes into contact with the spacer plate 13, grooves 33*a,* 33*b,* 33*c,* 33*d,* 33*e* are formed as shown in FIGS. 4, 7, 8A and 8B.

These grooves 33*a*–33*e,* 34, 35 are formed to prevent an adhesive 39 from entering the ink passages 12*a,* 12*b,* nozzles 15, pressure chambers 16, through holes 17, 18, and supply holes 19*a,* 19*b.*

The groove 33*a* is provided, as shown in FIG. 7, in the shorter side direction of the base plate 14, along the pressure chambers 16. Although the groove 33*a* is formed as three parallel grooves in this embodiment, as shown in FIG. 4, it may be configured differently.

As shown in FIG. 7, the groove 33*b* is formed along the other end passage 16*b.* The groove 33*d* is formed between the adjacent pressure chambers 16. The groove 33*c* is formed into a U-shape so as to extend from the tip of the groove 33*d,* parallel to the narrow groove 16*d.* An escape hole 37 is formed so as to penetrate the base plate 14 at a portion where the groove 33*d* branches out of the groove 33*b.* Also, an escape hole 36 is formed so as to penetrate the base plate 14 at a portion where the U-shaped groove 33*c* is connected to the groove 33*d.* The grooves 33*c* are provided on both sides of the base plate 14. Thus, the grooves 33*c* provided on both sides communicate with each other via the escape hole 36. The vertical cross-sectional area S1 of each groove 33*c* is adapted to be smaller than that of each narrow groove 16*d.*

The groove 33*e* is formed outside the groove 33*b* and along the edge of the base plate 14.

The grooves 33*a*–33*e,* 34, 35 are formed to have a certain depth in the respective plates, instead of penetrating them. In addition, the vertical cross-sectional area of each groove 33*a,* 33*b,* 33*d* is adapted to be smaller than that of each pressure chamber 16, each end passage 16*a,* and each other end passage 16*b.*

Figure 10:
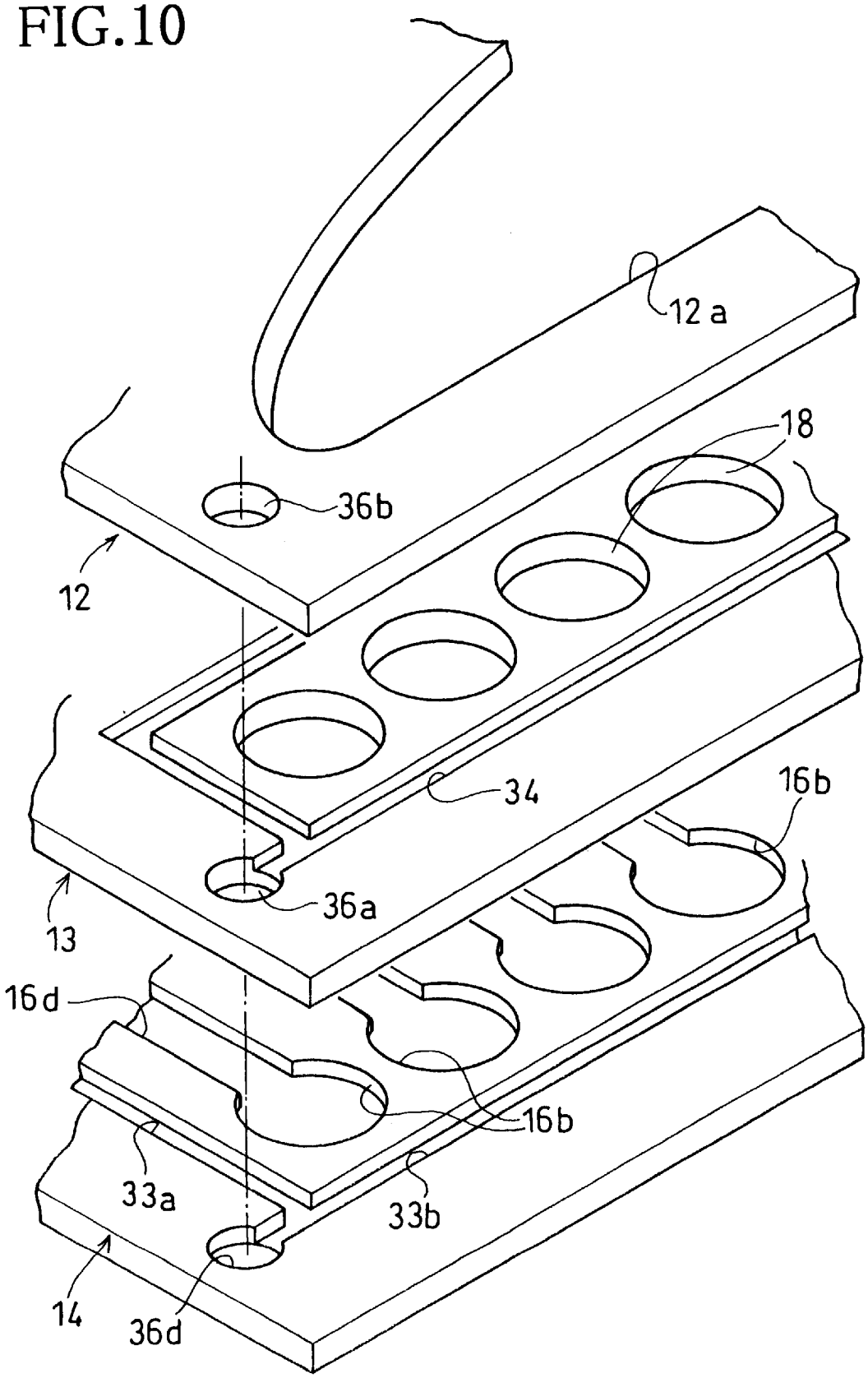
FIG. 10 is an enlarged perspective view of essential portions, such as escape grooves and escape holes.

As shown in FIG. 10, an escape hole 36*d* is formed near the grooves 33*a,* 33*b* so as to communicate with both of the grooves 33*a,* 33*b.* The escape hole 36*d* does not penetrate the base plate 14 and is formed as a recess with a depth equivalent to about half the thickness of the base plate 14.

Also, an escape hole 36*a* is formed in the spacer plate 13 so as to penetrate therethrough at a position near the groove 34 and aligned with the escape hole 36*d.*

An escape hole 36*b* is formed in the manifold plate 12 so as to penetrate therethrough at a position near the groove 35 and aligned with the escape holes 36*d,* 36*a.*

Further, an escape hole 36*c* is formed in the manifold plate 11 so as to penetrate therethrough at a position aligned with the escape holes 36*d,* 36*a,* 36*b.* Accordingly, the escape holes 36*a,* 36*b,* 36*d* communicate with each other and the escape hole 36*c* is open toward the outside.

The lead frames 100*a*–100*d* provided with manifold plates 11, 12, spacer plates 13, and base plates 14, structured as described above, are laminated upside down relative to the normal service state of the cavity plate 9, shown in FIG. 3. In the normal service state, the nozzles 15 are open toward the underside of the cavity plate 9. As shown in FIG. 4, a base plate 14, a spacer plate 13, a manifold plate 12, and a manifold plate 11 are laminated in this order from bottom to top.

Accordingly, the grooves 33*a*–33*e* in the base plate 14, the grooves 34 in the spacer plate 13, and the grooves 35 in the manifold plate 12 are all open upwardly.

Before the lead frames 100*a*–100*d* are laminated, the adhesive 39 is applied to the grooved surface of each plate. One of the methods of applying the adhesive 39 is to lightly apply the adhesive 39 to a flat surface of a jig and to bring the grooved surface of each plate into contact with the adhesive-coated surface of the jig. By this method, the adhesive 39 is transferred to, for example, flat portions in the base plate 14 and not to recessed portions, such as the grooves 33*a*–33*e,* the pressure chambers 16, and the escape holes 36, 37. Alternatively, a roller surface coated with the adhesive 39 may be pressed against the grooved surface of each plate in order to transfer the adhesive 39.

While the lead frames 100*a*–100*d* are stacked, positioning pins (not shown) are inserted, from the bottom, into the positioning holes 105 in the side frames 102. After that, a pinching force or a pressing force is applied to the lead frame 100*d* at the bottom and the lead frame 100*a* at the top in order to securely bond, with the adhesive 39, the base plate 14 to the spacer plate 13, the spacer plate 13 to the manifold plate 12, and the manifold plate 12 to the manifold plate 11.

When the lead frames 100*a*–100*d* are pressed, the adhesive 39 not used for bonding the adjacent plates flows into the grooves 33*a*–33*e,* 34, 35 formed in the corresponding plates and will not interfere with the ink flow.

In particular, the adhesive 39 should not enter the ink passages, such as the pressure chambers 19, the other end passages 16*b,* and the narrow grooves 16*d.* If the adhesive 39 flows into any narrow groove 16*d* with a small cross-sectional area, its entire cross section is clogged and the ink flow is completely blocked.

In this embodiment, such an event is prevented by capillary action. As capillary attraction is greater in a portion with a small cross-sectional area than in a portion with a large cross-sectional area, the adhesive 39 is first attracted to a portion with a small cross-sectional area.

More specifically, in this embodiment, the groove 33*c* is formed close to the corresponding narrow groove 16*d.* The vertical cross-sectional area S1 of each groove 33*c* is smaller than the vertical cross-sectional area S2 of each narrow groove 16*d.* Thus, the adhesive 39 not used for bonding the base plate 14 and the spacer plate 13 and remaining in the vicinity of the narrow groove 16*d* is first guided into the groove 33*c,* and the narrow groove 16*d* will not be clogged with the adhesive 39.

The groove 33*c* is formed substantially parallel to the narrow groove 16*d,* and thus capillary attraction acts on the groove 33*c* throughout its length. This prevents the adhesive 39 from entirely clogging the narrow groove 16*d.*

Likewise, the vertical cross-sectional area of each groove 33*a,* 33*b,* 33*d,* 34, 35 is adapted to be smaller than that of each pressure chamber 16, each end passage 16*a,* each other end passage 16*b,* and each through hole 17, 18. Thus, the adhesive 39 is first guided into the grooves 33*a,* 33*b,* 33*d,* 34, 35. This prevents the adhesive 39 from clogging the pressure chambers 16, the end passages 16*a,* the other end passages 16*b,* and the through holes 17, 18. Accordingly, a good flow of ink can be ensured and high print quality can be maintained.

Figure 8A:
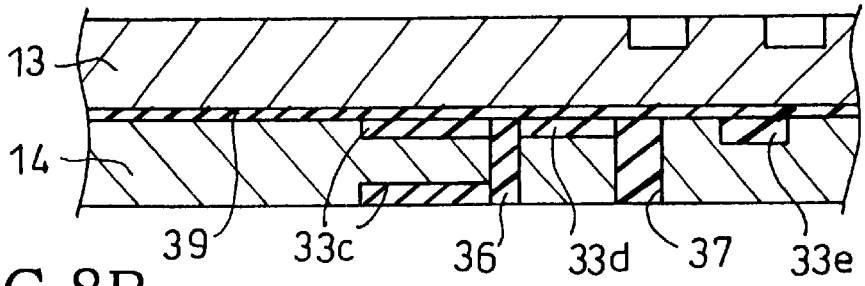
FIG. 8A is a cross-sectional view taken along line VIIIa—VIIIa of FIG. 7.
Figure 8B:
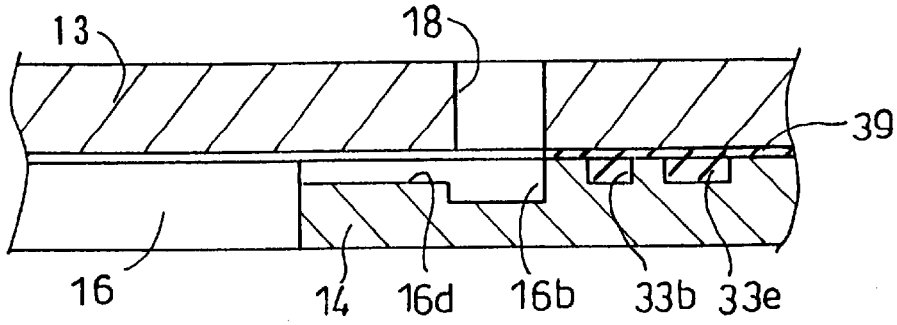
FIG. 8B is a cross-sectional view taken along line VIIIb—VIIIb.

As shown in FIG. 8A, the groove 33*c* on the front side of the base plate 14 communicates with the groove 33*c* on the back side thereof through the escape hole 36. This allows an excessive adhesive 39 to escape toward the back side of the base plate 1 through the escape hole 36. Especially, since only a limited space is left around the pressure chamber 16 and the area occupied by the grooves 33*b,* 33*c,* 33*d* is small, the groove 33*c* provided on the back side is very effective.

The escape hole 37 also allows the excessive adhesive 39 to escape therethrough.

In addition, because the grooves 33*b,* 33*d* are provided around the corresponding other end passage 16*b,* the adhesive 39 is guided into the grooves 33*b,* 33*d,* without flowing into the other end passage 16*b.*

In the spacer plate 13 and the manifold plate 12, the grooves 34, 35 are concentrated around the through holes 17, 18. Thus, the excessive adhesive 39 flows into the grooves 34, 35, instead of clogging the through holes 17, 18. Especially, any through holes 17 should not be clogged with the adhesive 39 because ink is supplied through the through holes 17 for ejection.

When bonding is completed as described above, a plurality of sets of 4-layer plates, made up of manifold plates 11, 12, a spacer plate 13, and a base plate 14, are linked to the lead frames 100*a*–100*d* via connecting pieces 106. By cutting the connecting pieces to detach a set of 4-layer plates from the lead frames 100*a*–100*d* and by bonding, using an adhesive, a nozzle plate 10 to the manifold plate 11, a cavity plate 9 is finally produced. The grooves 50 formed in the manifold plate 11 prevent the adhesive from clogging the through holes 17 in the manifold plate 11.

Figure 11A:
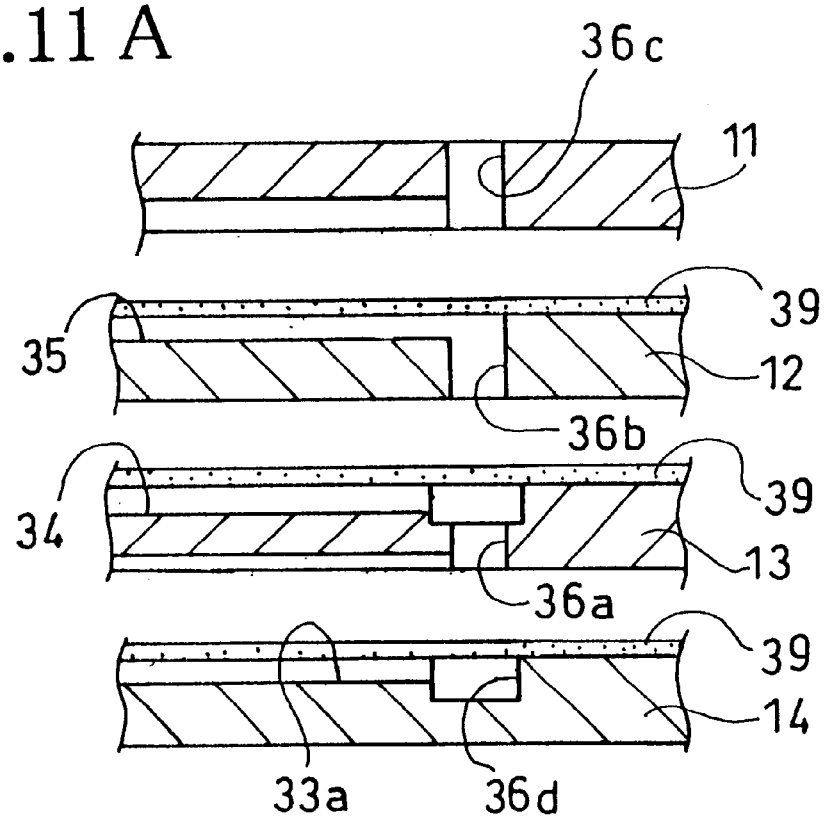
FIG. 11A is a cross-sectional view of the escape grooves and the escape holes in each plate coated with an adhesive before lamination.
Figure 11B:
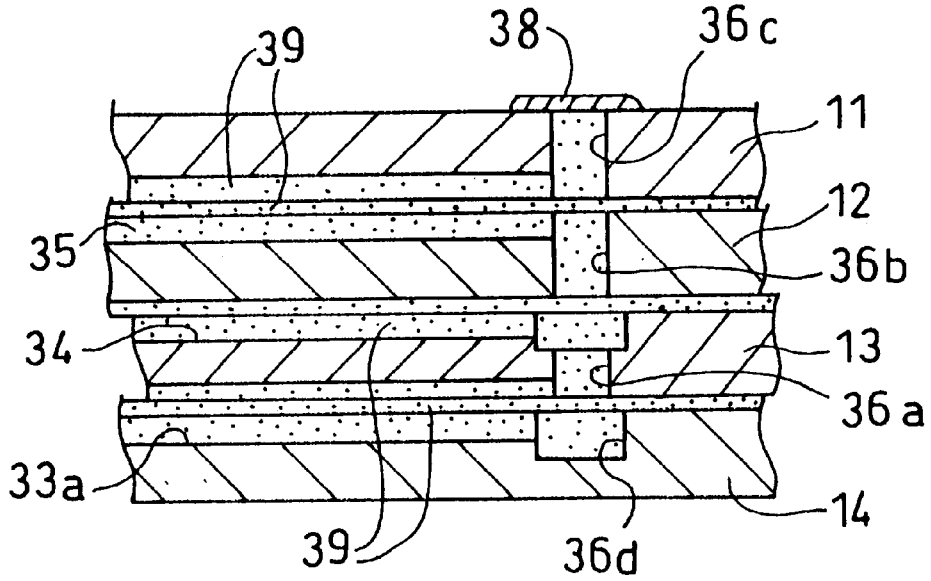
FIG. 11B is a cross-sectional view of the laminated and bonded plates.

The excessive adhesive 39 still remaining after flowing into the grooves 33*a*–33*e,* 34, 35 fills the escape holes 36*a*–36*d,* as shown in FIG. 11B. When the manifold plates 11, 12, the spacer plate 13, and the base plate 14 are bonded to each other, air trapped between the bonding surfaces and contained in the adhesive 39 moves through the grooves 33*a*–33*e,* 34, 35 and the escape holes 36*a*–36*d* and is discharged to the outside of the plates.

As a result, the plates are securely bonded with the adhesive 39, which contains no air bubbles and remains as a layer between the bonding surfaces, and ink leaks from the bonding surfaces are reliably prevented.

In addition, as shown in FIG. 11B, the escape hole 36*c* is sealed with a sealant 38 applied over the upper surface of the manifold plate 11. This prevents ink leaks more reliably.

Figure 12:
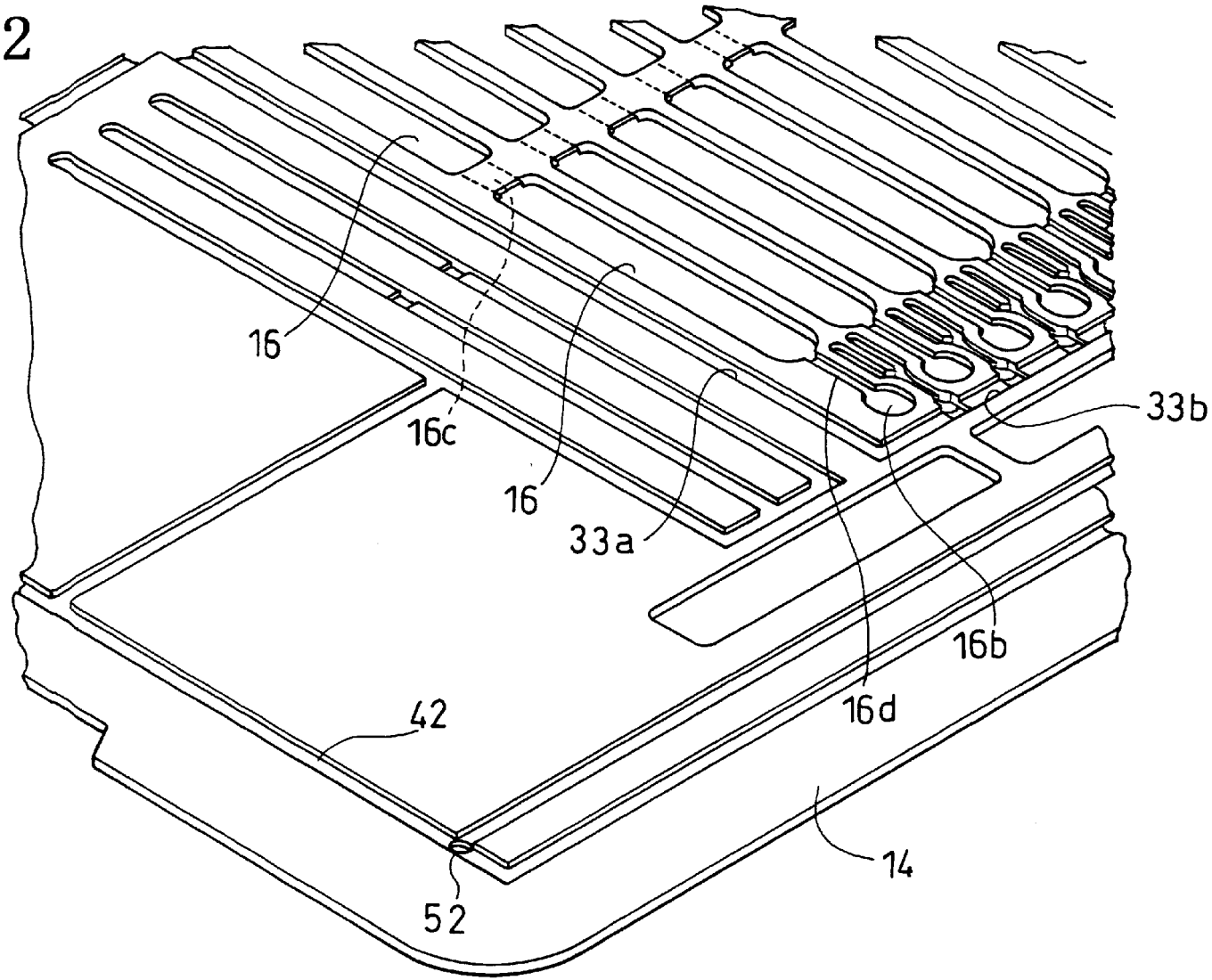
FIG. 12 is an enlarged perspective view of essential portions, such as other escape grooves and escape holes in the base plate.

As shown in FIGS. 4 and 12, additional grooves 42, 43, 44 may be provided away from the ink passages, such as the pressure chambers 16 and the through holes 17, 18. Further, additional escape holes 52, 53, 54, 55 may be provided in the grooves 42, 43, 44.

Figure 14:
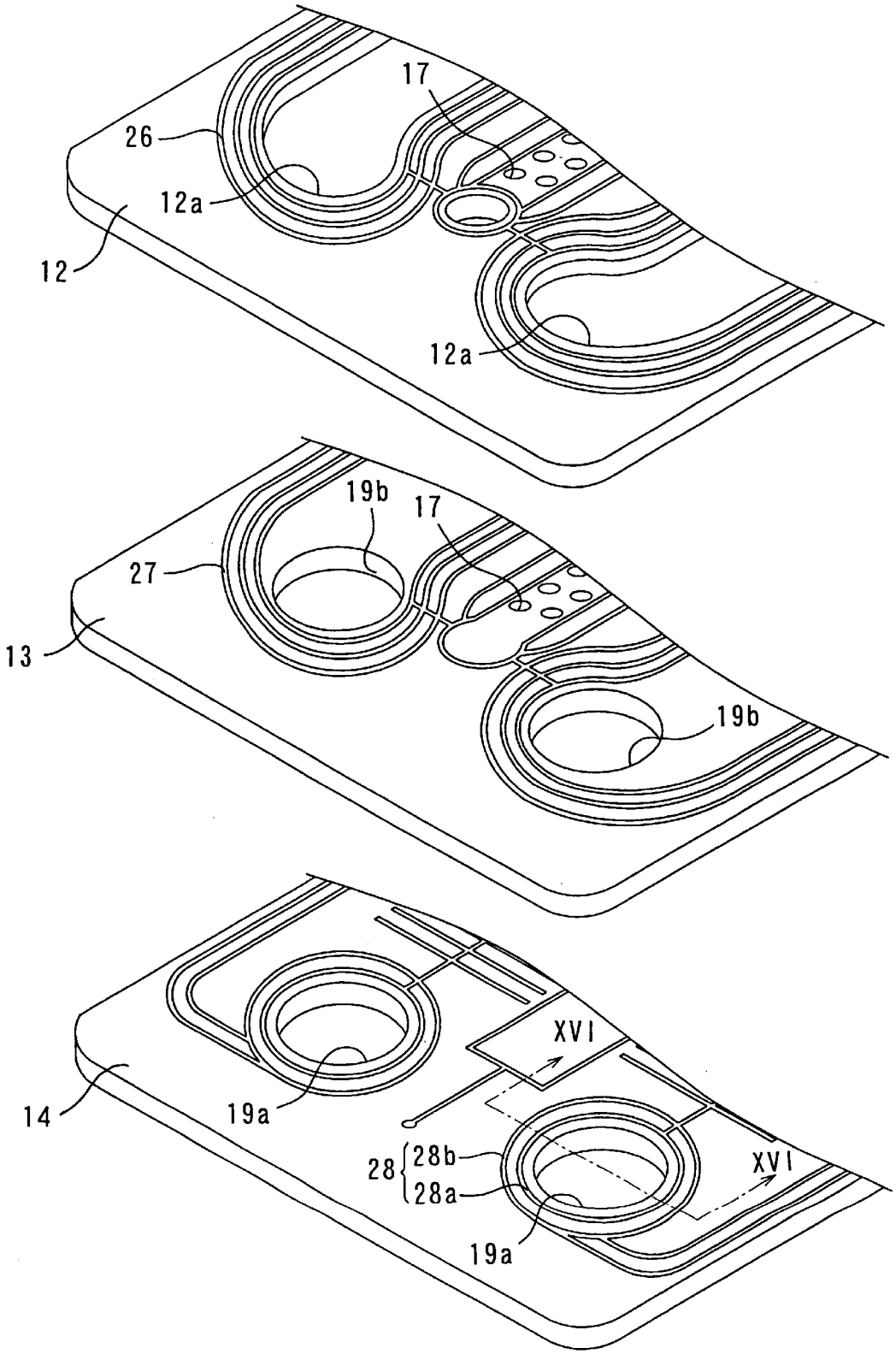
FIG. 14 is an enlarged view of grooves formed in the plates.

As shown in FIG. 14, grooves 26 are formed around the ink passages 12*a* provided in the manifold plate 12. Grooves 27 are formed around the supply holes 19*b* provided in the spacer plate 13. Also, grooves 28 are formed around the supply holes 19*a* provided in the base plate 14. Similarly to other grooves, these grooves 26, 27, 28 are provided to allow the excessive adhesive 39 to escape thereinto.

The grooves 28 provided around each of the supply holes 19*a* are formed into two circles that are different in diameter and concentric with the supply hole 19*a.* An inner groove 28*a* is smaller in diameter than an outer groove 28*b.*

The above-described grooves 33*a,* 33*b,* 33*d,* 33*e,* 34, 35, 26, 27, 28 are formed on one side of each of the corresponding manifold plates 11, 12, spacer plate 13, and base plate 14, and none of these grooves are formed on the other side of each corresponding plate.

The reason for forming grooves on only one side of each plate will be described with reference to FIGS. 15A, 15B, 16A, and 16B.

Figure 15A:
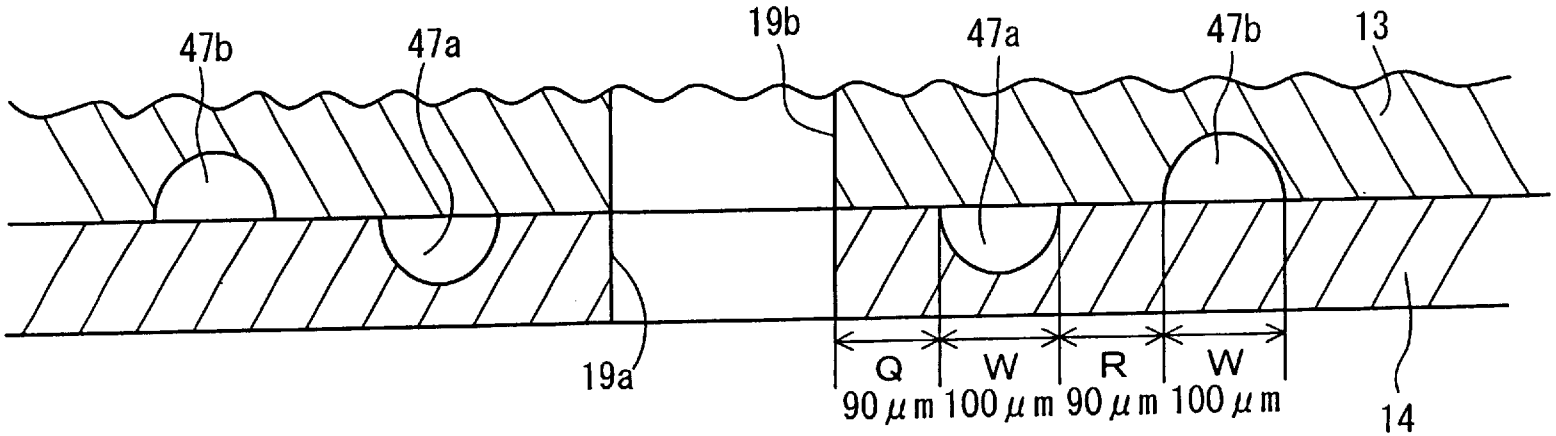
FIGS. 15A and 15B show examples where grooves are formed on both of opposed surfaces of adjacent plates.
Figure 15B:
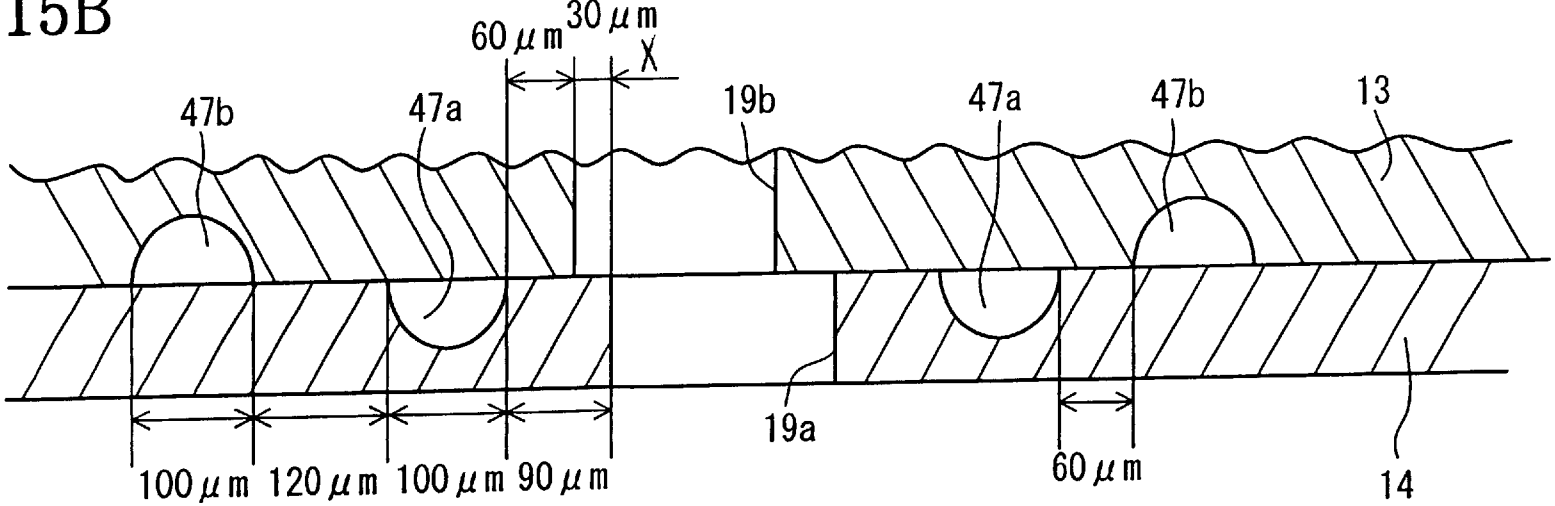
Figure 16A:
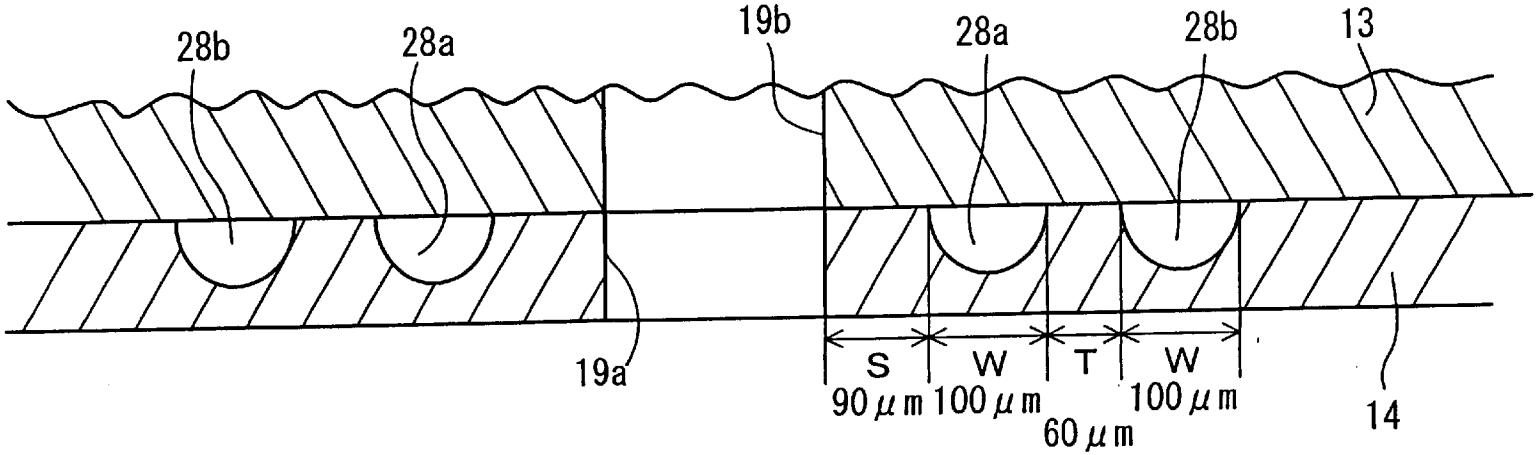
FIGS. 16A and 16B show examples where grooves are formed on only one of opposed surfaces of adjacent plates.
Figure 16B:
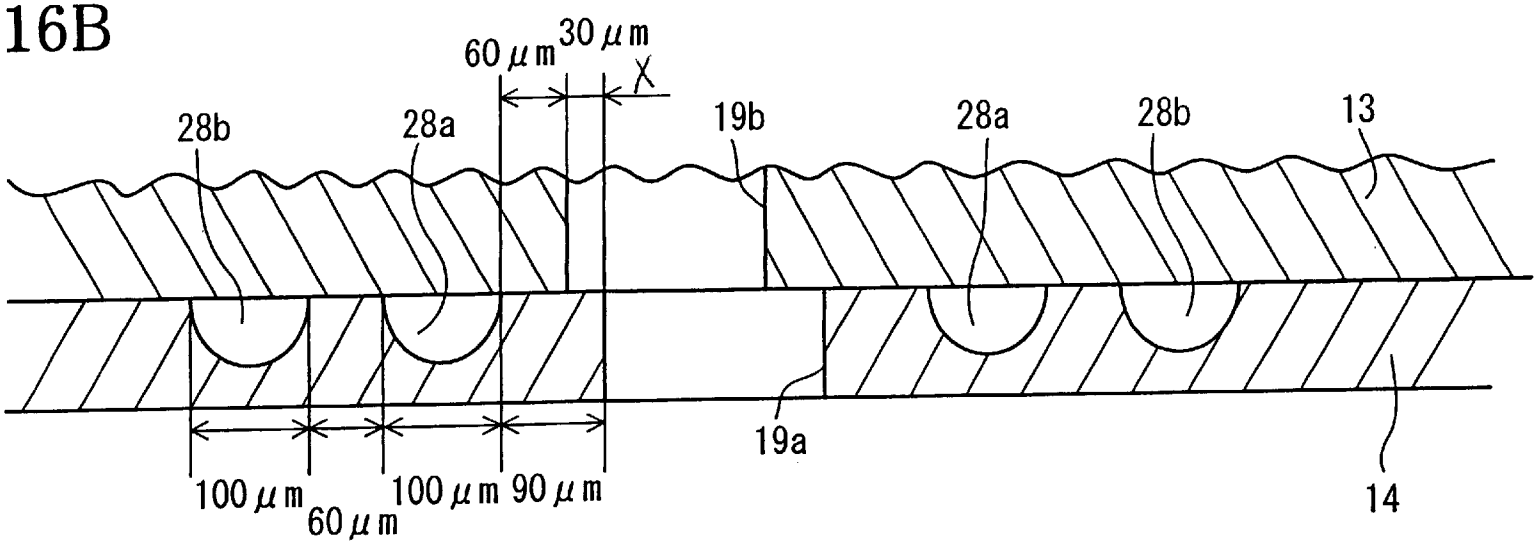

FIGS. 15A and 15B show grooves formed on both of opposed surfaces of adjacent plates, while FIGS. 16A and 16B show grooves formed on only one of opposed surfaces of adjacent plates. FIGS. 16A, and 16B are cross-sectional views taken along line XVI—XVI of FIG. 14 when the spacer plate 13 is superposed on the base plate 14. A groove 47*b,* shown in FIGS. 15A and 15B, formed on the underside of the spacer plate 13 corresponds to the outer groove 28*b* shown in FIGS. 16A and 16B respectively, while a groove 47*a,* shown in FIGS. 15A and 15B, formed in the base plate 14 corresponds to the inner groove 28*a* shown in FIGS. 16A and 16B respectively.

When the grooves 47*a,* 47*b* are formed on the opposed surfaces, as shown in FIG. 15A, these grooves 47*a,* 47*b* are positioned in consideration of a displacement X, shown in FIG. 15B, produced when the spacer plate 13 is superposed on the base plate 14.

FIG. 15A shows a state where the spacer plate 13 is superposed on the base plate 14 without any displacement, while FIG. 15B shows a state where the space plate 13 is superposed on the base plate 14 and is displaced by 30 μm, which is the maximum allowable displacement.

When the spacer plate 13 is displaced from the base plate 14 by 30 μm, as shown in FIG. 15B, a distance between the supply hole 19*b* and the groove 47*a* and a distance between the grooves 47*a,* 47*b* should be at least 60 μm to ensure secure bonding between the spacer plate 13 and the base plate 14.

Assuming that the width W of each groove 47*a,* 47*b* is 100 μm, the maximum allowable displacement X is 30 μm, and that the width required for bonding is 60 μm, a distance Q between the edge of the supply hole 19*a* and the inner edge of the groove 47*a* will be 90 μm, as a sum of 60 μm and the maximum allowable displacement X of 30 μm. In other words, the groove 47*a* is formed in the base plate 14 such that its inner edge is positioned 90 μm away from the edge of the supply hole 19*a*.

Also, a distance between the outer edge of the groove 47*a* and the inner edge of the groove 47*b* will be 90 μm, as a sum of 60 μm and the maximum allowable displacement X of 30 μm. In other words, the groove 47*b* is formed in the spacer plate 13 such that its inner edge is positioned 90 μm away from the outer edge of the groove 47*a,* when the displacement X is xero.

As a result, a distance between the edge of the supply hole 19*a* and the inner edge of the groove 47*b* is obtained by Q+W+R and will be 90+100+90=280 μm.

Meanwhile, when the grooves 28*a,* 28*b* are formed only in the base plate 14, as shown in FIGS. 16A and 16B, the grooves 28*a,* 28*b* are positioned as described below.

A distance S between the edge of the ink supply hole 19*a* and the inner edge of the groove 28*a* is obtained, as with the distance Q, by summing 60 μm and the maximum allowable displacement X of 30 μm and will be 90 μm. In other words, the groove 28*a* is formed in the base plate 14 such that its inner edge is positioned 90 μm away from the edge of the supply hole 19*a*.

A distance between the outer edge of the groove 28*a* and the inner edge of the groove 28*b* will be 60 μm, which is required for bonding. As opposed to the distance R, the maximum displacement X does not need to be considered here. In other words, the groove 28*b* is formed in the base plate 14 such that its inner edge is positioned 60 μm away from the outer edge of the groove 28*a*.

Even when the spacer plate 13 is displaced from the base plate 14 by 30 μm at the maximum, as shown in 16B, the distance between the grooves 28*a,* 28*b* remains 60 μm and allows the spacer plate 13 and the base plate 14 to be securely bonded to each other.

As a result, a distance between the edge of the ink supply hole 19*a* and the inner edge of the groove 28*b* is obtained by S+W+T and will be 90+100+60=250 μm, which is shorter by 30 μm than the case shown in FIG. 15A. Accordingly, the grooves 28*a,* 28*b* can be formed in a smaller range, and the surfaces of the spacer plate 13 and the base plate 14 can be used more effectively.

Additionally, as shown in FIG. 15B, when the grooves 47*a,* 47*b* are formed in the opposing surfaces of the spacer plate 13 and the base plate 14 and when the spacer plate 13 is displaced by 30 μm from the base plate 14, a distance from the edge of the supply hole 19*a* in the base plate 14 to the outer edge of the groove 47*b* in the spacer plate 13 will be 90+100+(90+30)+100=410 μm. In this case, a larger space is required for the outside of the groove 47*a.*

In contrast, when two grooves 28*a,* 28*b* are formed side by side in the base plate 14, as shown in FIG. 16B, a distance from the edge of the supply hole 19*a* to the outer edge of the outer groove 28*b* is 90+100+60+100=350 μm constantly, regardless of a variable displacement between the spacer plate 13 and the base plate 14. Accordingly, the grooves 28*a,* 28*b* can be arranged densely in the vicinity of the supply hole 19*a*. In addition, a larger space is not required for the outside of the groove 48*a.* Thus, these grooves 28*a,* 28*b* makes a ink-jet head compact.

As a representative example, grooves provided around the supply hole 19*a* in the base plate 14 have been described. The above-described effect will be enhanced if grooves in other plates are formed in the same manner on only one of opposed bonding surfaces.

Further, when the spacer plate 13 and the base plate 14 are bonded to each other, application of an adhesive to the surface of the spacer plate 13 will allow the adhesive to uniformly spread between the bonded two plates.

Alternatively, an adhesive may be applied to the grooved surface of the base plate 14 so as not to enter the grooves. If the adhesive enters the grooves before the two plates are bonded, the grooves will not be able to perform their primary function of guiding thereinto an excessive adhesive.

As shown in FIGS. 4 and 14, grooves except for the grooves 33*c* are formed on only one side of each plate in this embodiment. Formation of grooves on both sides of each plate may deteriorate the plate strength. This embodiment, however, is free from such a problem and each plate has a sufficient strength.

Figure 6:
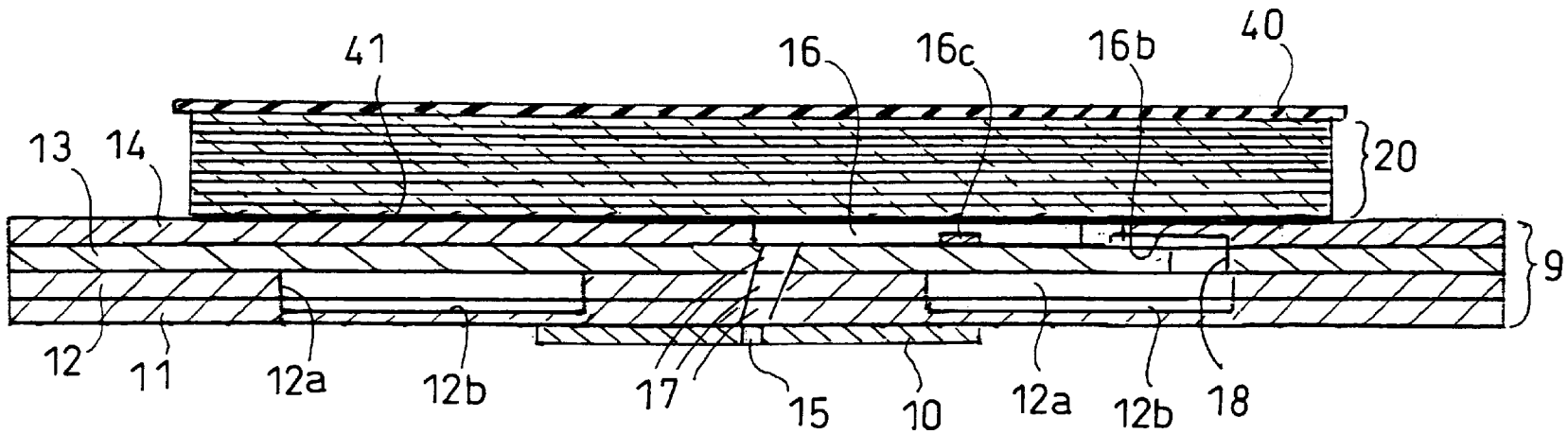
FIG. 6 is an enlarged cross-sectional view of a flexible flat cable, the cavity plate, and a piezoelectric actuator that are bonded to each other.

Turning to FIGS. 5 and 6, the piezoelectric actuator 20 is shown. The piezoelectric actuator 20 is constructed by laminating a plurality of piezoelectric sheets 21. By pasting the adhesive sheet 41 to the entire lower surface of the piezoelectric actuator 20, the piezoelectric actuator 20 is bonded to the cavity plate 9. The flexible flat cable 40 is pressed against the upper surface of the piezoelectric actuator 20 and is soldered to surface electrodes 30, 31 formed on the upper surface of the piezoelectric actuator 20 to establish an electrical connection.

The construction of the piezoelectric actuator 20 is disclosed in detail in U.S. patent application Ser. No. 09/933,155 titled PIEZOELECTRIC INK-JET PRINTER HEAD AND METHOD OF FABRICATING SAME.

Figure 13:
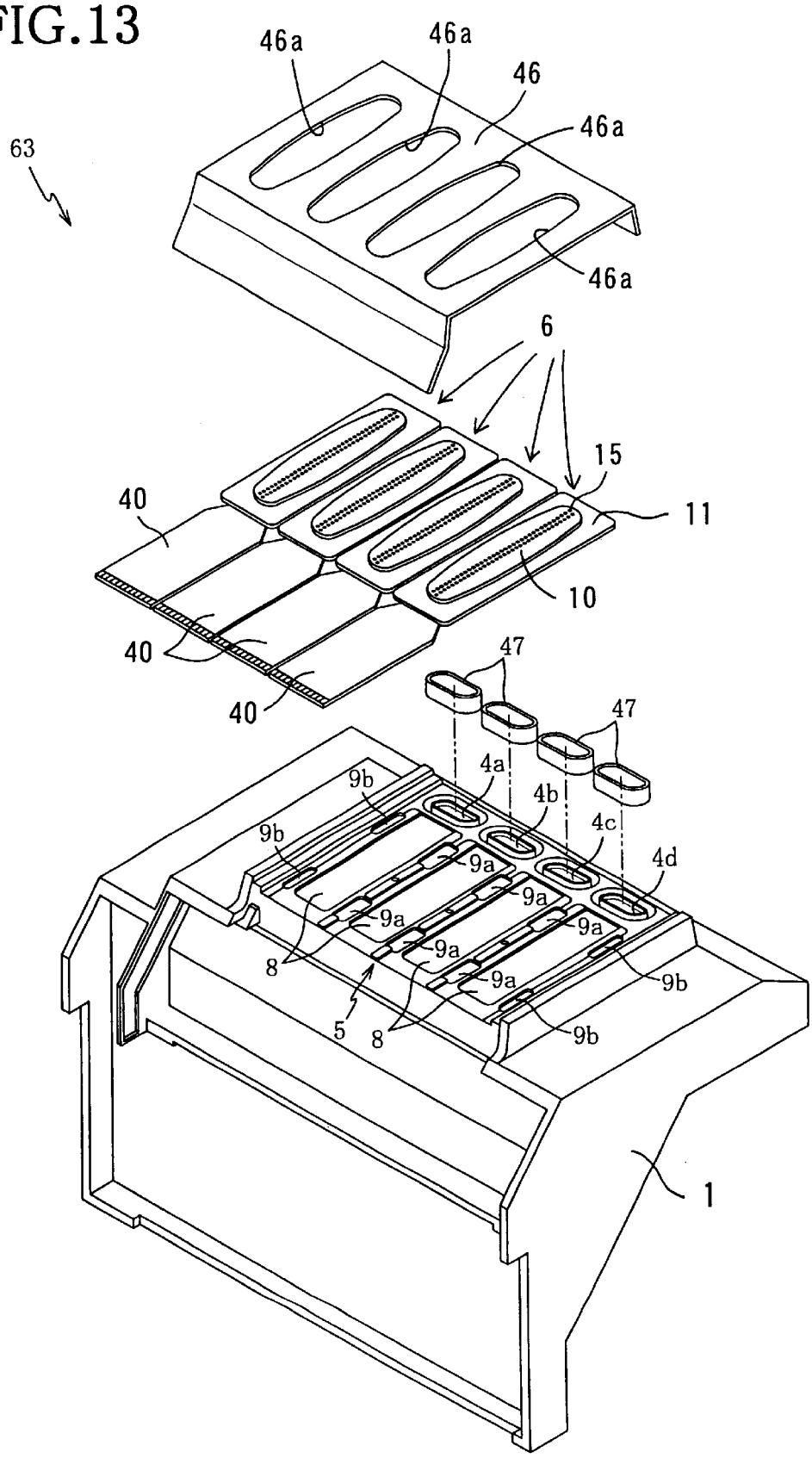
FIG. 13 is a perspective view of an ink-jet printer head and a head holder that are turned upside down.

Preferably, open ends of the escape holes 36*c,* 55 are sealed using a cover plate 46, as shown in FIG. 13.

In order to securely mount newly produced ink-jet printer heads 6 to a head holder 1, an adhesive is applied between the manifold plates 11 and the cover plate 46 with windows 46*a* through which the nozzle plates 10 are exposed, and then the ink-jet printer heads 6 are covered by the cover plate 46. Thereby, clearance between the edges of the windows 46 and the ink-jet printer heads 6 as well as the open ends of the escape holes 36*c,* 55 are sealed. Grooves 45 formed in the manifold plate 11, as shown in FIG. 4, guide an excessive adhesive thereinto.

Figure 17:
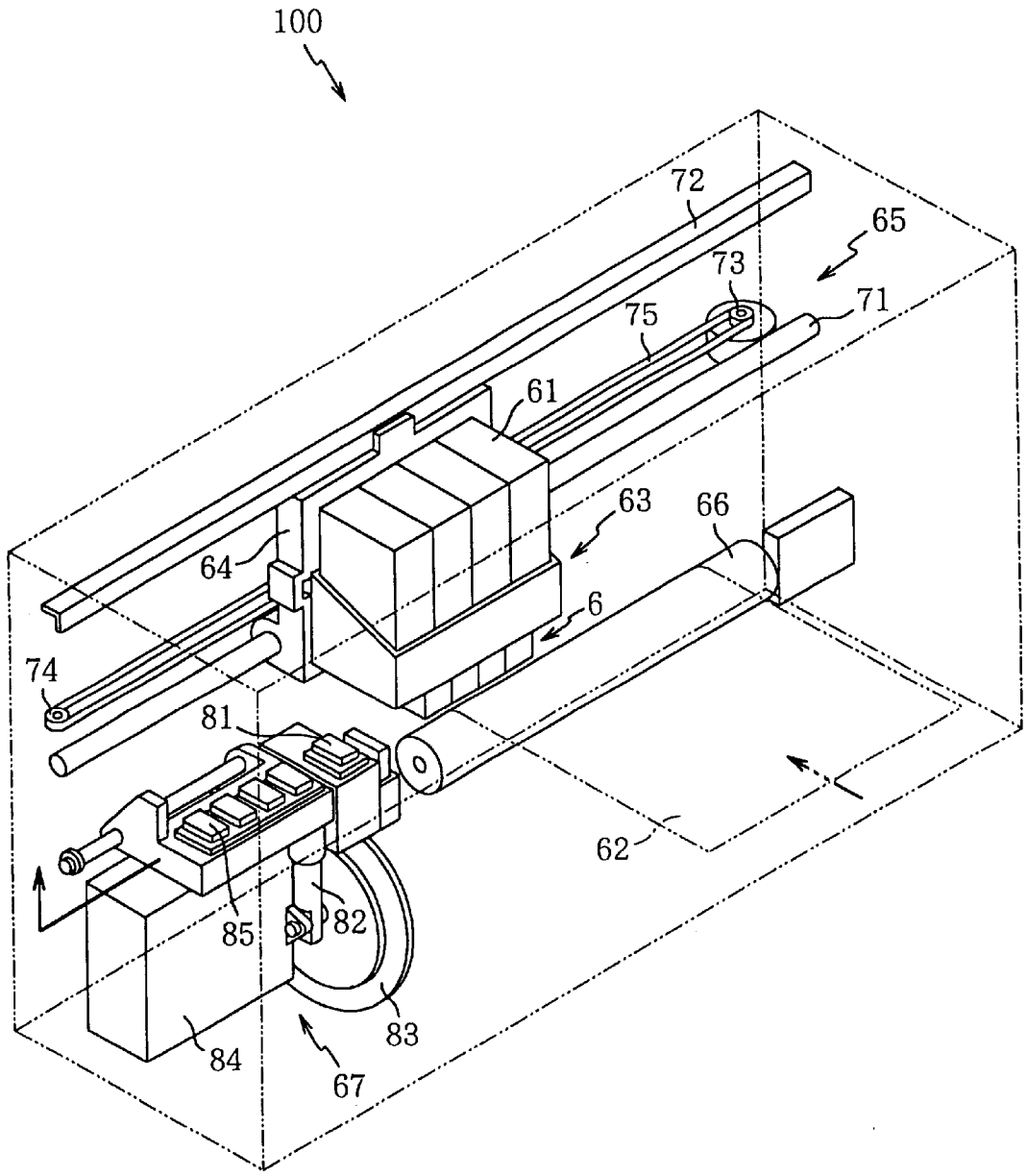
FIG. 17 is a perspective view of a color ink-jet printer.

As shown in FIGS. 13 and 17, a head unit 63 is formed into substantially a box with its top surface open and has the head holder 1 to which four ink cartridges 61 are detachably mounted. At one side of the head holder 1, ink supply passages 4*a,* 4*b,* 4*c,* 4*d,* each connectable to an ink outlet of each of the ink cartridges 61, are formed through the underside of a bottom plate 5 of the head holder 1. A rubber packing 47 is disposed in each of the ink supply passages 4*a,* 4*b,* 4*d,* 4*d* so as to seal the corresponding ink supply hole 19*a*.

On the underside of the bottom plate 5, four stepped supports 8 are formed to receive the four ink-jet heads 6 side by side. In the vicinity of each of the supports 8, a plurality of openings 9*a,* 9*b* are formed through the bottom plate 5. A UV adhesive is charged into the openings 9*a,* 9*b* in order to securely bond the ink-jet heads 6.

FIG. 17 is a perspective view of a color ink-jet printer 100. The color ink-jet printer 100 includes the four ink cartridges 61 that respectively store cyan, magenta, yellow, and black inks, the head unit 63 having ink-jet heads 6 for printing on a sheet 62, a carriage 64 that carries the ink cartridges 61 and the ink-jet heads 6, a drive unit 65 that lineally reciprocates the carriage 64, a platen roller 66 extending, opposed to the ink-jet heads 6, along the reciprocating direction of the carriage 64, and a purge unit 67.

The drive unit 65 includes a carriage shaft 71 disposed at the lower end of the carriage 64 so as to extend parallel to the platen roller 66, a guide plate 72 disposed at the upper end of the carriage 64 so as to extend parallel to the carriage shaft 71, two pulleys 73, 74 disposed 71 between the carriage shaft 71 and the guide plate 72 and at both ends of the carriage shaft 71, and an endless belt 75 looped between the pulleys 73, 74.

When the pulley 73 is rotated in a forward or reverse direction by the rotation of the motor, the carriage 64 connected to the endless belt 75 reciprocates linearly along the carriage shaft 71 and the guide plate 72.

The sheet 62 is fed from a sheet feed cassette (not shown) provided on one side of the ink-jet printer 100 and is guided between the ink-jet heads 6 and the platen roller 66. Printing is performed by ink ejection from the ink-jet heads 6 onto the sheet 62, and then the sheet 62 is discharged. A sheet feed mechanism and a sheet discharge mechanism are omitted from FIG. 17.

The purge unit 67 is provided on one side of the platen roller 66 and faces the ink-jet heads 6 when the head unit 63 is brought into its reset position. The purge unit 67 includes a cap 81 that covers the nozzles 15 of any one of the ink-jet heads 6, a pump 82, a cam 83, and an ink tank 84. The nozzles 15 of any one of the ink-jet heads 6 are covered with the cap 81 when the head unit 63 is in its reset position. Then, deteriorated ink containing air bubbles or foreign matter and trapped in the ink-jet head 6 is sucked through the nozzles 15 by the pump 82 driven by the cam 83. As a result, the ink-jet head 6 is restored to its working condition. Sucked ink is stored in the ink tank 84.

Protective caps 85 are used to cover the nozzles 15 to prevent the ink from drying. Upon the completion of printing, the carriage 64 moves to its reset position where the nozzles 15 are opposed to the protective caps 85.

While the invention has been described with reference to specific embodiments, the description of the specific embodiments is illustrative only and is not to be construed as limiting the scope of the invention. Various other modifications and changes may occur to those skilled in the art without departing from the spirit and scope of the invention.

What is claimed is:

1. An ink-jet printer head, comprising:

a nozzle plate having a plurality of nozzles for ejecting ink;

a base plate having a plurality of pressure chambers and at least one base plate groove adjacent to the plurality of the pressure chambers, each pressure chamber corresponding to each nozzle;

a manifold plate having at least one ink passage and at least one manifold plate groove disposed adjacent to the at least one ink passage; and the nozzle plate, the base plate, and the manifold plate being stacked using an adhesive applied therebetween so that excess adhesive flows into the base plate groove and the manifold plate groove.

2. An ink-jet printer head as claimed in claim 1, wherein:

the manifold plate includes at least one manifold plate escape hole connected with the at least one manifold plate groove;

the base plate includes at least one base plate escape hole connected with the at least one base plate groove; and the manifold plate escape hole and the base plate escape hole are aligned.

3. An ink-jet printer head as claimed in claim 1, the manifold plate further comprising a plurality of manifold plate through holes and a plurality of manifold plate grooves disposed adjacent to the plurality of manifold plate through holes, each one of the plurality of manifold plate through holes corresponding to each one of the plurality of nozzles disposed in the nozzle plate.

4. An ink-jet printer head as claimed in claim 3, wherein a cross sectional area of each manifold plate groove is less than a cross sectional area of each manifold plate through hole.

5. An ink-jet printer head as claimed in claim 1, further comprising:

a spacer plate having a plurality of spacer plate through holes, and a plurality of lateral grooves and a plurality of longitudinal grooves, each one of the plurality of the lateral and longitudinal grooves being disposed adjacent to the plurality of spacer plate through holes; and the spacer plate being disposed between the base plate and the manifold plate.

6. An ink-jet printer head as claimed in claim 5, wherein a cross sectional area of each of the plurality of longitudinal and lateral grooves is less than a cross sectional area of each spacer plate through hole.

7. An ink-jet printer head as claimed in claim 1, the base plate further comprising a plurality of base plate grooves disposed adjacent to the pressure chambers.

8. An ink-jet printer head as claimed in claim 7, wherein each pressure chamber of the plurality of pressure chambers includes an end passage and an other end passage, and the base plate includes a base plate groove disposed adjacent to each end passage and each other end passage.

9. An ink-jet printer head as claimed in claim 8, the base plate further comprising a base plate groove disposed parallel to each pressure chamber of the plurality of pressure chambers.

10. An ink-jet printer head as claimed in claim 9, wherein a cross sectional area of each base plate groove is less than a cross sectional area of each pressure chamber of the plurality of pressure chambers, each end passage, and each other end passage.

11. An ink-jet printer head as claimed in claim 9, the base plate further comprising a narrow groove disposed between each pressure chamber of the plurality of pressure chambers and each other end passage of the other end passages, the narrow groove having a cross sectional area greater than the cross sectional area of each base plate groove of the plurality of base plate grooves.

12. A method for manufacturing an ink-jet printer head, comprising:

providing a nozzle plate having a plurality of nozzles for ejecting ink;

providing a base plate having a plurality of pressure chambers, each pressure chamber corresponding to each nozzle and having at least one base plate groove adjacent to the plurality of pressure chambers;

providing a manifold plate having at least one ink passage and at least one manifold plate groove disposed adjacent to the ink passage; and stacking the nozzle plate, the base plate and the manifold plate using an adhesive disposed therebetween, wherein excess adhesive flows into the base plate groove and the manifold plate groove.

13. A method for manufacturing an ink-jet printer head as claimed in claim 12, further comprising:

providing at least one manifold plate escape hole in the manifold plate and connecting the at least one manifold plate escape hole with the at least one manifold plate groove;

providing at least one base plate escape hole in the base plate and connecting the at least one base plate escape hole with the at least one base plate groove; and forming an escape hole adhesive collection area by aligning the at least one manifold plate escape hole with the at least one base plate escape hole.

14. An electrical component, comprising:

a plurality of plates, at least one of the plurality of plates including a pattern and having at least one groove adjacent to the pattern, wherein the plates are stacked using an adhesive applied therebetween so that excess adhesive flows into the at least one groove.

15. An electrical component as claimed in claim 14, wherein each one of the plurality of plates includes at least one escape hole, and the escape holes of each plate are aligned to form an adhesive collection area.

16. An electrical component as claimed in claim 14, wherein the at least one of the plurality of plates includes a first surface and a second surface and the at least one groove is disposed on only the first surface.

17. An ink-jet printer head, comprising:

a nozzle plate having a plurality of nozzles for ejecting ink;

a base plate having a first base plate surface, a second base plate surface, a plurality of pressure chambers and at least one base plate groove adjacent to the plurality of the pressure chambers, the at least one base plate groove being disposed only on the first base plate surface;

a manifold plate having a first manifold plate surface, a second manifold plate surface, at least one ink passage and at least one manifold plate groove adjacent to the at least one manifold plate groove, the at least one manifold plate groove being disposed only on the first manifold plate surface, the base plate and the manifold plate being stacked in such a manner that the first base plate surface opposes the second manifold plate surface; and an adhesive applied at the first base plate surface so that excess adhesive flows into the at least one base plate groove.

18. The ink-jet printer head as claimed in claim 17, wherein the nozzle plate and the manifold plate are stacked in such a manner that the first manifold plate surface opposes the nozzle plate, and the adhesive is applied at the first manifold plate surface so that excess adhesive flows into the at least one manifold plate groove.

19. The ink-jet printer head as claimed in claim 18, further comprising:

a spacer plate having a first spacer plate surface, a second spacer plate surface, a plurality of spacer plate through holes and at least one spacer plate groove adjacent to the plurality of the spacer plate through holes, the at least one spacer plate groove being disposed on only the first spacer plate surface, each spacer plate through hole corresponding to each nozzle, the spacer plate and the manifold plate being stacked in such a manner that the first spacer plate surface opposes the second manifold plate surface;

wherein the adhesive is applied between the first spacer plate surface and the second manifold plate surface so that excess adhesive flows into the at least one spacer plate groove.

20. The ink-jet printer head as claimed in claim 19, wherein the spacer plate further comprises at least one spacer plate ink supply hole, the at least one spacer plate groove including a plurality of lateral grooves, a plurality of longitudinal grooves, and at least one spacer plate curved groove, wherein each of the plurality of lateral grooves and each of the plurality of longitudinal grooves is disposed on only the first spacer plate surface and adjacent to the plurality of spacer plate through holes, and the at least one spacer plate curved groove is disposed on only the first spacer plate surface and about the at least one spacer plate ink supply hole.

21. The ink-jet printer head as claimed in claim 19, wherein:

the base plate includes at least one ink supply hole penetrating the base plate, and the at least one base plate groove further comprises a first circular groove and a second circular groove, the first circular groove and the second circular groove being separate and disposed in concentric circles about the at least one ink supply hole;

the first base plate surface opposes the second spacer plate surface; and the first circular groove defines an inner edge and the at least one ink supply hole defines a second edge, and the inner edge is separated from the second edge by at least 60 $\mu$m.

22. The ink-jet printer head as claimed in claim 21, wherein the first circular groove defines a first edge and the second circular groove defines a third edge, and the first edge is separated from the third edge by 60 $\mu$m.

23. The ink-jet printer head as claimed in claim 21, wherein the inner edge of the first circular groove is offset by at least 90 $\mu$m from the second edge.

24. The ink-jet printer head as claimed in claim 21, wherein the first circular groove defines an outer edge and the second circular groove defines a second inner edge, and the outer edge and the second inner edge are separated by at least 60 $\mu$m.

25. The ink-jet printer head as claimed in claim 18, wherein:

the base plate includes at least one ink supply hole penetrating the base plate, and the at least one base plate groove further comprises at least one base plate circular groove disposed around the at least one ink supply hole; and the base plate and manifold plate are stacked so that the first base plate surface opposes the first manifold plate surface, and the at least one base plate groove is offset from the at least one manifold plate groove.

26. The ink-jet printer head as claimed in claim 25, wherein the at least one base plate circular groove further comprises two circular concentric grooves, each circular concentric groove having a different diameter and surrounding the at least one ink supply hole.

* * * * *